United States Patent [19]

Kaiser et al.

[11] Patent Number: 4,813,471

[45] Date of Patent: Mar. 21, 1989

[54] METHOD FOR DETERMINING MOLTEN METAL POOL LEVEL IN TWIN-BELT CONTINUOUS CASTING MACHINES

[75] Inventors: Timothy D. Kaiser, Colchester, Vt.; Sabah S. Daniel, Pittsburgh, Pa.; Charles D. Dykes, Milton, Vt.

[73] Assignees: Hazelett Strip-Casting Corporation, Colchester, Vt.; USX Corporation, Pittsburgh, Pa.

[21] Appl. No.: 190,364

[22] Filed: May 5, 1988

[51] Int. Cl.[4] ..... B22D 11/18

[52] U.S. Cl. ..... 164/451; 164/453; 164/150; 164/449

[58] Field of Search ..... 164/451, 453, 155, 449, 164/450, 481, 150, 431, 432

[56] References Cited

U.S. PATENT DOCUMENTS 3,864,973 2/1975 Petry ..... 164/449

FOREIGN PATENT DOCUMENTS 0123450 10/1984 European Pat. Off. ..... 164/453

*Primary Examiner*—Kuang Y. Lin

*Attorney, Agent, or Firm*—Parmelee, Bollinger & Bramblett

[57] ABSTRACT

A method for determining level of molten metal in the input of a continuous metal casting machine having at least one endless, flexible, revolving casting belt with a surface which engages the molten metal to be cast and a reverse, cooled surface along which is directed high velocity liquid coolant includes the steps of predetermining the desired range of positions of the molten metal pool and positioning at least seven heat-sensing transducers in bearing contact with the moving reverse belt surface and spaced in upstream-downstream relationship relative to belt travel spanning the desired pool levels. A predetermined temperature threshold is set, somewhat above coolant temperature and the output signals of the transducer sensors are scanned regarding their output signals indicative of temperatures of the moving reverse belt surface. Position of the molten pool is determined using temperature interpolation between any successive pair of upstream-downstream spaced sensors, which follows confirmation that two succeeding downstream sensors are at temperature levels exceeding threshold temperature. The method accordingly provides high resolution for determining pool position, and verifies the determined position by utilizing full-strength signals from two succeeding downstream sensors. In addition, dual sensors are used at each position spanning the desired range of molten metal pool levels to provide redundancy, wherein only the higher temperature of each pair of sensors at a station is utilized.

15 Claims, 2 Drawing Sheets

METHOD FOR DETERMINING MOLTEN METAL POOL LEVEL IN TWIN-BELT CONTINUOUS CASTING MACHINES

BACKGROUND

The present invention relates to a method for determining the operating conditions in a continuous metal casting machine of the type having an endless casting belt for confining molten metal introduced into the input of the machine, and more particularly to a method for determining the pool level of the molten metal supplied to the input region of the belt casting machine.

Continuous casting machines are used to cast long lengths of metal strip or slab of preselected dimension directly from molten metal. The molten metal is confined adjacent to the front surface of a flexible, endless moving metal belt which is moved along with the metal being cast as the molten metal is introduced into the machine from an external source. The molten metal is carried along by the casting belt as it solidifies, while a high velocity flow of liquid coolant is applied along the reverse surface of the casting belt to cool it and to extract heat from the metal adjacent to the belt, thereby providing solidification of the metal into the strip or slab being formed by the machine.

It is important that the molten metal be introduced into the input region of the continuous casting machine at a rate which is effectively synchronized with the casting rate of the machine as determined by the belt travel to maintain the pool of molten metal in the input region of the machine at a desired level. When the input feed rate exceeds the casting rate, the pool level will creep up. When the input feed rate is less than the casting rate, the pool level will creep down into the machine allowing the molten metal being introduced to cascade too far before reaching the pool causing splashing and turbulence within the machine. Such splashing and turbulence causes non-uniformity and segregation in the cast product.

When the input feed rate is accurately and controllably matched to the casting rate, these casting belt machines can be run continuously for long periods to successfully and efficiently cast large tonnages of strip or slab product. In practice, it is difficult to meter precisely the input feed rate of molten metal and also difficult to determine the level of the molten pool, because in most cases the molten pool is hidden from sight by the equipment associated with the input region of the machine.

The continuous movement of the casting belt and the high velocity liquid coolant rushing along the reverse surface of the belt are further impediments to the determination of pool level. Since the molten metal is at its highest temperature as it is being introduced into the pool, the amount of heat flux is greatest, and so intense and continuous cooling of the reverse surface of the belt is essential in the input and pool region of the casting machine.

A variety of methods have previously been used in attempts to determine the pool level of molten metal being cast in such continuous casting machines. Among these methods is the use of the operator's eye as well as photoelectric and thermal sensors. (Even radioactive sources of neutrons have been suggested for using neutron penetration to sense metal levels.) However, these prior art techniques, including visual observations, have often been less than fully satisfactory.

Improved results have been obtained by the method and apparatus disclosed in U.S. Pat. Nos. 3,364,973; 3,921,697; and 4,712,602. The present invention is directed to improving further the resolution and accuracy of the manner in which pool level is determined by the method and apparatus disclosed in these patents as well as providing redundancy to increase accuracy and reliability.

Furthermore, when casting high temperature melting metals such as steel in thin sections, pool-level sensing is even more difficult, because the input region is narrow in height and blocked from visual observation. This narrow vertical height when casting thin sections means that the entering free stream of molten metal running down into the pool is often some 50% to 70% of the thickness (height) of the mold cavity itself in which the cast product is being formed. A wave or splash of the entering stream or molten metal pool input will produce rapid changes in contact of very hot metal with the casting belt, causing inaccuracies or confusions in pool level determinations. Accordingly, increased resolution and accuracy is very desirable, particularly when casting thin sections of high temperature melting metals, such as steel.

SUMMARY OF THE DISCLOSURE

Accordingly, it is an object of this invention to provide a new method of determining the pool level of the molten metal in the input of a continuous casting machine of the type having at least one endless, flexible casting belt with a casting surface which engages the molten metal to be cast, such method providing greater resolution in the location of the pool level of the molten metal than previous methods and apparatus.

A further object of this invention is to provide a new and improved method of determining the level of the molten metal in the input of a continuous metal casting machine, which has greater accuracy in locating the pool level and in addition, provides verification of that location.

Still a further object of this invention is to provide a new and improved method for determining the level of the molten metal in the input of a continuous twin-belt metal casting machine which uses a plurality of spaced temperature sensors, in which the position of the pool is capable of being interpolated between successive sensors when the pool level is located between sensors.

In carrying out this invention in one illustrative embodiment thereof, a method is provided for determining the level of the molten metal in the input of a continuous metal casting machine of the type having at least one endless, flexible, revolving casting belt with a casting surface which engages the molten metal to be cast and a reverse, cooled surface along which is directed a substantially continuous high velocity flow of liquid coolant, the casting surface being covered with a belt coating to insulate and protect the belt from the molten metal and to control the rate of cooling of the molten metal. This method comprises predetermining the desired range of operation of the position of the molten metal pool in the input region of the casting machine and positioning a series of at least seven heat sensing transducers in bearing contact with the moving, reverse cooled surface of the casting belt and in upstream-downstream spaced relation with respect to the direction of travel of the belt in respective positions to span the desired predetermined range in pool positions. A predetermined temperature threshold is set which is above the temperature of the liquid coolant, and output signals from the respective heat-sensing transducers are sequentially monitored for changes in temperature of the moving, reverse cooled surface of the belt at the respective upstream-downstream positions of these sensors. The position of the molten metal pool is then determined by using temperature interpolation between a pair of successive sensors, which follows confirmation that two succeeding detectors are at temperature levels exceeding the threshold temperature.

An algorithm is provided for automatically determining the level of the pool based on the information provided by the output signals from the series of temperature sensors which span the desired position of the pool level with respect to the moving casting belt. The water coolant temperature is maintained in a range of 70° to 90° F. with a threshold offset temperature of approximately 40° F., thereby providing a threshold temperature range of 110° to 130° F.

BRIEF DESCRIPTION OF THE DRAWINGS

The invention, together with further objects, aspects, features and advantages thereof, may best be understood by reference to the following description taken in connection with the accompanying drawings.

DESCRIPTION OF THE PREFERRED EMBODIMENTS

Figure 1:
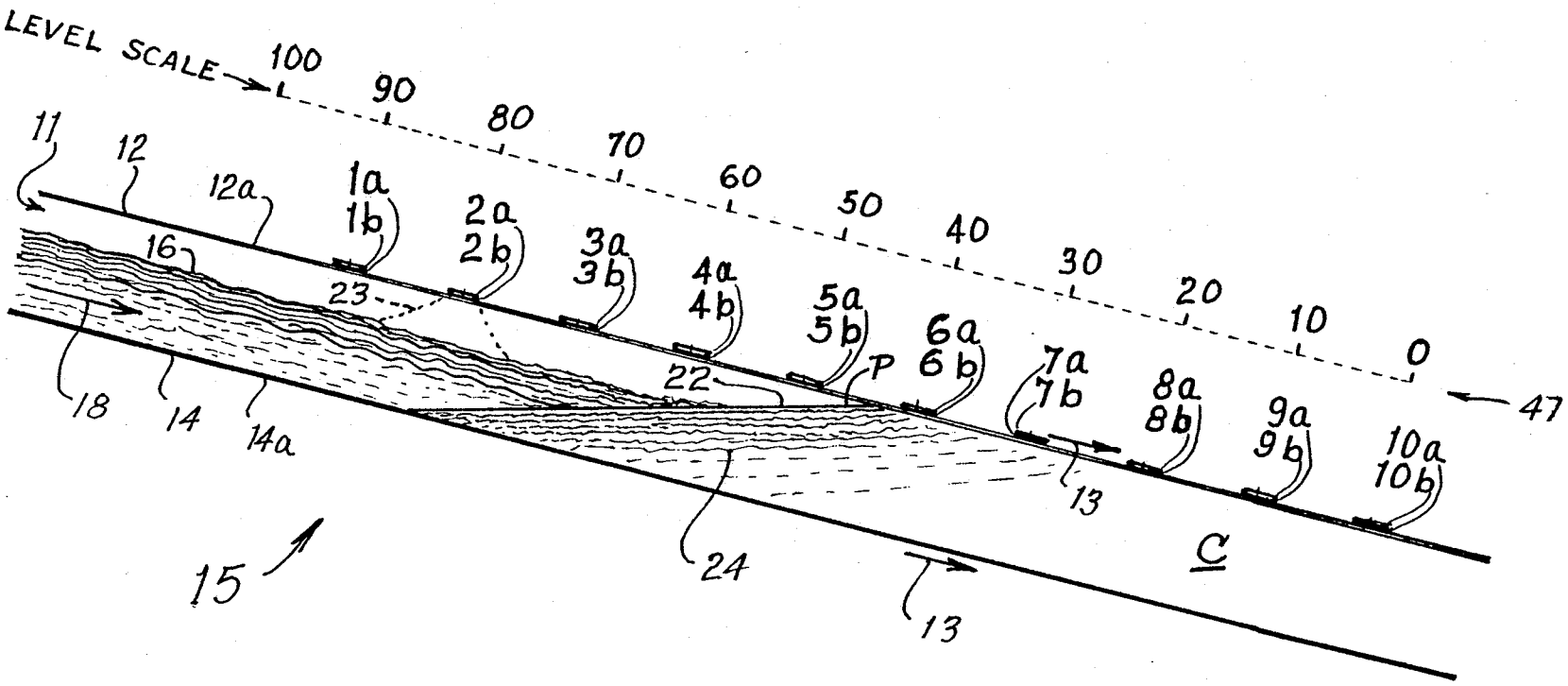
FIG. 1 is a diagrammatic side elevational view of a twin-belt continuous metal casting machine equipped with a dual series of heat sensing detectors in contact with the reverse surface of the upper belt and which are used to determine the molten metal pool level.

Referring now to FIG. 1, a continuous metal casting machine, referred to generally with the reference number 15 includes upper and lower casting bolts 12 and 14 movable in the direction of the arrows 13. The details of the continuous metal casting machine are shown and described in the aforesaid patents and accordingly are not repeated here. Molten metal for example steel, which is desired to be cast into strips or slabs, is supplied through the input 11 of the casting machine 15 and flows downwardly as a free stream 16 in the direction of the arrow 18 entering into the casting region C and forming a molten pool 22 of the molten metal 24 in the casting region. The casting region C is defined between the spaced parallel front surfaces of the upper and lower flexible casting belts 12 and 14.

The flexible casting belts 12 and 14 are fabricated from steel, or other metals or alloys which provide toughness and resistance to abrasion and physical damage as well as resistance to the heat shocks and temperature differentials undergone during casting. Belt coatings on the front belt surfaces insulate and protect the belt from the molten metal and help to control the rate of cooling of the molten metal. For example, such belt coatings may be as described in U.S. Pat. No. 4,588,021. The reverse surface 12*a* of the upper casting belt 12 is cooled by a substantially continuous high velocity v flow of liquid coolant which is not shown. Such coolant flow is well known in the art of twin-belt casting machines. The same type of high velocity coolant flow is also provided for the reverse surface 14*a* of belt 14.

In order to determine the position or level P of the pool 22 of the molten metal 24 in the input region 11 of the machine 15, there are dual series 1*a*–10*a* and 1*b*–10*b* of heat sensing transducers. In other words, the first series 1*a* through 10*a* includes ten sensors, and the second series 1*b* through 10*b* also includes ten sensors being respectively adjacent the first series for providing ten sensing stations 1 through 10 for reliability of redundance and for increased accuracy. These two series of heat sensors engage against the cooled reverse surface 12*a* of the upper casting belt 12. These sensors are spaced in the upstream-downstream direction 13 in ten stations and are positioned so as to bridge or span the predetermined desired range in positions of the level P of the pool 22 of the molten metal 24 in the casting region C of the machine.

The sensor transducers 1*a*–10*a* and 1*b*–10*b* may be any suitable transducers for providing an output signal as a known function of sensed temperature of the reverse surface 12*a* of the upper belt 12. For example, thermocouples mounted by any suitable means for positioning the sensors in a fixed location in bearing relation with the reverse cooled belt surface 12*a* may be utilized for providing output signals indicative of sensed temperature. Suitable forms of mounting are illustrated in the aforesaid patents. Each of the sensor pairs 1*a* and 1*b*, 2*a* and 2*b*, 3*a* and 3*b* etc., are near each other in transverse alignment so that any given sensor station spanning the range of the pool level P contains two close-together temperature sensors, thereby providing a redundancy and an accuracy in accord with the method to be explained in a preferred form. The highest temperature indicated by the two sensors at a given station is always utilized for control. The use of two series of temperature sensors provides redundancy and insures a reading even if one of the sensors in a station is faulty or for some reason does not make good contact with the moving belt 12.

Figure 2:
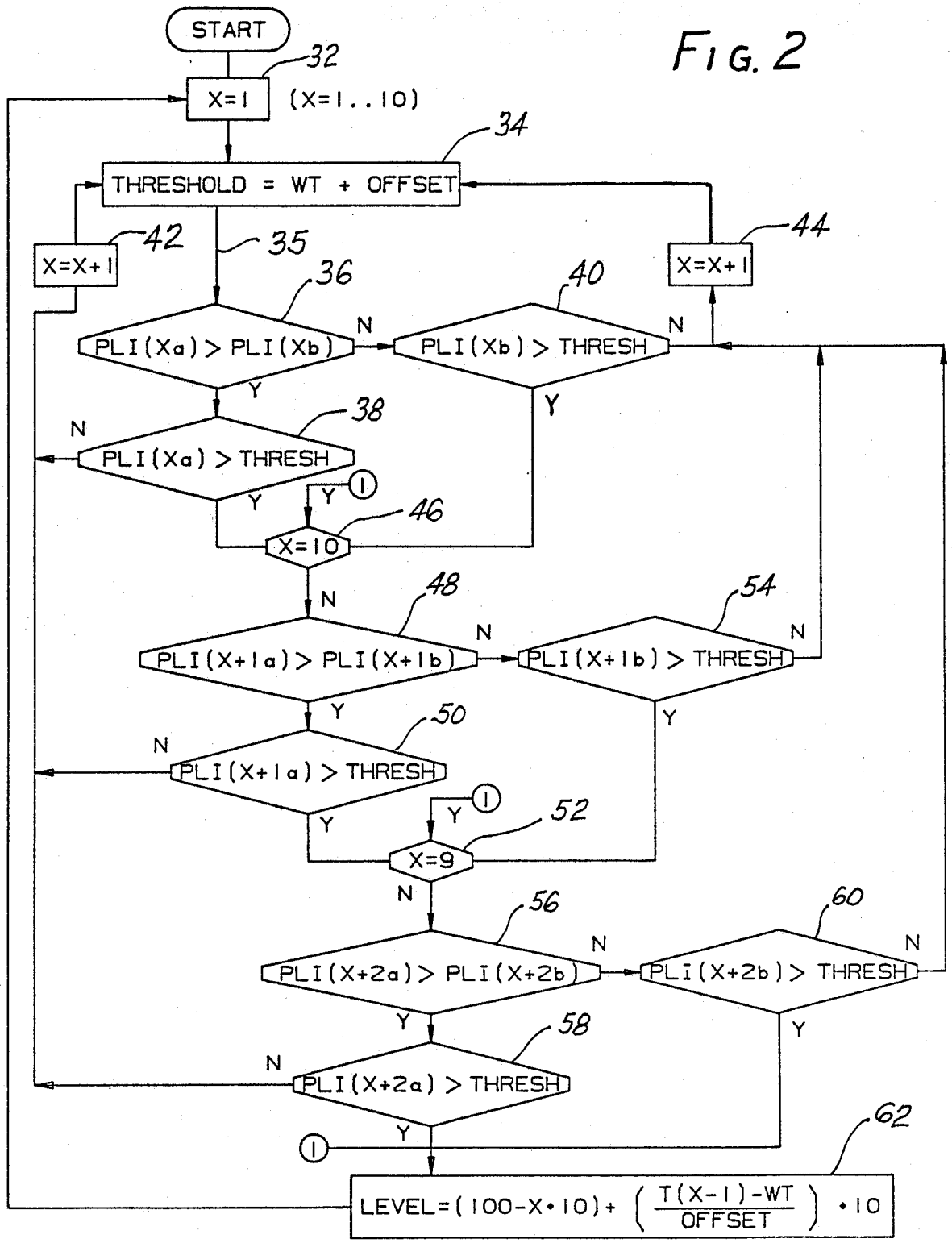
FIG. 2 is a flow chart illustrating the processing and algorithm utilized in determining the molten metal pool level in conjunction with FIG. 1.

Before explaining the algorithm for the system as illustrated in FIG. 2, some general comments will be made about the approach utilized in accurately determining the pool level in accordance with this invention. As was pointed out, the predetermined desired range in the pool level P is bridged by a plurality of pairs of sensors. One purpose of the dual rows of sensors is to be able to select the higher temperature of the two for each location or station to eliminate a number of uncertainties in taking and obtaining the actual temperatures. Such uncertainties might include, for example, changes due to belt motion, changes in the amount of contact or pressure holding a sensor against the travelling belt, momentary water skiing or hydroplaning of the bottom of a sensor riding upon the fast-flowing coolant, localized splashing or wave cresting 23 of the hot metal stream 16 against a local area of the belt 12 upstream of the pool 22, etc. or a combination of these conditions.

Thus, having two detectors at each station and taking the higher detector temperature provides a redundancy for greater accuracy, and if one detector should malfunction, another detector is in place to get the reading. The position of the pool level P when it occurs between detector stations is interpolated to give a more accurate position of the actual pool level P.

Another feature of the present invention is that two successive detector stations subsequent to the determined pool level will have to be triggered in order to substantiate (confirm) that the pool level is truly at a determined level.

Accordingly, in this method a "threshold temperature" is picked which exceeds (by an "offset") the "liquid coolant temperature" of the coolant which is used to cool the belts. That "liquid coolant temperature" is defined as that of the liquid coolant while in the reservoir, before being applied to the reverse side 12*a* of the upper belt. The "offset" is set at a level above the "liquid coolant temperature" for providing an indication of the molten pool approaching or contacting the casting side of the belt 12. Thus, the "threshold temperature" is the "liquid coolant temperature" plus the "offset", and this threshold temperature is used to determine the position P of the molten metal pool 22. For purposes of explanation, the "liquid coolant temperature" was in the range of about 70° to 90° F. and the "offset" was chosen at a value of 40°, thereby providing a "threshold temperature" in the range of about 110° to 130°. For example, when the liquid coolant temperature is about 85° F., then the threshold temperature is set 40° F. higher, namely at about 125° F., which is typical of operating conditions.

Turning now to FIG. 2, which illustrates the pool level indicator algorithm, the terms are defined as follows:

X=sensor position (sensor station)
Threshold=Liquid Coolant Temperature (or Water Temperature "WT")+Offset
PLI=pool level indicator (sensor)
Xa=position of sensor in a series
Xb=position of sensor in b series
T=temperature of the sensor at a specific position The system is operated by scanning downwardly from the upper sensors 1*a*, 1*b* which means progressively sampling the outputs of the sensor pairs 1*a*, 1*b* through 10*a*, 10*b*. Accordingly, scanning 32 monitors the output of the sensor pairs 1*a*, 1*b*, etc. The functional block 34 indicates that an output signal from any sensor Xa or Xb to be significant must exceed the water temperature ("WT") plus the Offset, which for example in the illustration chosen would be about 110° F. to 130° F. The scanning 32 continues with a sensor signal being applied (arrow 35) to a first comparator 36, where it is determined whether the temperature of sensor position Xa exceeds the temperature of the sensor position Xb. Accordingly, in comparison step 36, the higher temperature of each sensor pair is determined. If Xa exceeds Xb, the signal is applied to comparator 38 to see of the higher temperature signal exceeds the threshold.

If the higher temperature of the sensor pair Xa exceeds the threshold then the system shifts over to a confirmation mode to be explained later. Similarly, if the Xb temperature is higher as determined by comparison 36, and its temperature exceeds threshold, as determined by comparison 40, then the system shifts over to the confirmation mode.

In the absence of any temperature exceeding threshold, this stepping forward of the scanning continues as indicated at 42 and 44 until there is a comparison 38–40 in which a sensor at a particular station has a higher temperature than its neighbor, and also its temperature exceeds threshold. When a sensor temperature exceeds threshold then the logic shifts into a confirmation mode, as indicated at 46. If the particular sensor having a temperature greater than threshold is a sensor at station 10, namely 10*a* or 10*b*, then the pool level P is known to be down near the zero position on the "LEVEL SCALE" 47, at the lower limit of the desired range of levels for the pool level P. The rate of metal feed 18 is increased slightly, or the casting belt travel 13 is slowed slightly, or both, for raising the pool level P up toward the mid-position (50 on the LEVEL SCALE).

If the comparison 38 is affirmative, and if the progression of the scan 46 is not at station 10, then the next confirmation takes place in step 48, where the next succeeding sensor position is examined to determine if one of the two sensors in the succeeding station also indicates a temperature above Threshold.

A need for the confirmation mode will be appreciated from FIG. 1 where the incoming stream of metal 16 happens to create a wave or splash 23 which comes into contact with the upper belt 12. In such a situation at least one of the sensors 2*a* or 2*b* is likely to indicate a temperature above threshold. Thus, during scanning, this occurrence of a temperature above threshold at station 2 will cause the operation to shift over to a confirmation mode to determine if the sensors at the next succeeding two stations 3 and 4 also indicate a temperature above threshold. In this situation of a wave or splash 23 at station 2 the sensors at stations 3 and 4 will not indicate temperatures above threshold. Consequently, there is nonconfirmation. Thus, the above-threshold temperature occurring at station 2 will be determined not to indicate pool level P.

In the situation shown in FIG. 1, at least one of the pair of sensors 6*a* and 6*b* will indicate a temperature above threshold. The progressive scanning will have taken place, until the sensors 6*a* and 6*b* are scanned. These sensors 6*a* and 6*b* now correspond with pool level indicator (PLI) sensors Xa and Xb in FIG. 2. Since the higher temperature sensor Xa or Xb will indicate a temperature above threshold the logic shifts over to the confirmation mode as indicated at 46, wherein sensors X+1*a* and X+1*b* now correspond to the sensors 7*a* and 7*b* and sensors X+2*a* and X+2*b* now correspond to the sensors 8*a* and 8*b*. The purpose of the confirmation mode is to determine if a sensor in station 7 and also a sensor in station 8 have temperatures above threshold, thereby confirming that the pool level P is at or above station 6. Thus, confirmation is a two-step process, which calls for above-threshold readings in the two succeeding stations in order to conclude that a confirmation has been obtained.

Turning attention again to FIG. 2, if the sensor 1+1*a* has the higher temperature, as compared in step 48, the operation proceeds to the first confirmation comparison step 50, where the temperature of the sensor X+1*a* is compared to threshold. If the temperature of sensor X+1*a* exceeds threshold, a first step in the confirmation has been obtained, and the logic proceeds to the second confirmation step as indicated at 52.

If it happens that the sensor X+1*b* has the higher temperature and its temperature is greater than threshold, a first step in the confirmation has been obtained, and the logic proceeds to the second confirmation step as indicated at 52.

If neither of the threshold comparisons 50 or 54 is affirmative, then there is no confirmation, and the logic shifts back to further scanning, as indicated at 42 or 44.

When the first confirmation step is affirmative at 50 or 54, the operation proceeds to the second confirmation step at 52. If the progression of the confirmation scan is at station 9, then the pool level P is known to be down near the ten position on the LEVEL SCALE 47, near the lower limit of the desired range of levels for the pool level P. The rate of metal feed 18 is increased slightly, or the casting belt travel 13 is slowed slightly, or both, for raising the pool level P up toward the mid-position fifty on the LEVEL SCALE 47.

If the progression of the confirmation scan is not already at station 9, then the second confirmation step takes place by comparing at 56 the temperature of sensors X+2*a* and X+2*b*. If sensor X+2*a* has the higher temperature in the comparison 56, and if the temperature of this sensor X+2*a* also exceeds threshold in the comparison 58, then confirmation has been obtained, and the logic then determines the pool level, as indicated by the function rectangle 62, to be explained later.

If the comparison 56 shows that the sensor X+2*b* has a higher temperature, and if comparison 60 shows that its temperature is above threshold, then confirmation has been obtained, and the pool level is determined as indicated by the function 62. If confirmation is not obtained in either comparison 58 or 60, then the system returns to the original scanning mode, as indicated at 42 and 44.

When confirmation has been obtained that the above threshold reading of station 6 (FIG. 1) is validated by above-threshold readings also occurring at stations 7 and 8, then the pool level is calculated by the formula shown in the rectangle 62 in FIG. 2. This formula is:

$$\text{LEVEL} = (100 - 10X) + 10\left[\frac{T(X-1) - WT}{\text{OFFSET}}\right] \quad (1)$$

In this formula, "X" represents a confirmed station, namely "X" represents station 6 as being the confirmed station, in the illustrative example of FIG. 1. Thus, from the front portion of this formula, the pool level P is determined to be at least 100–10X, which is 100–60, which equals 40. In other words, the pool level is determined to be at least at level forty on the position LEVEL SCALE 47.

The second portion of the above formula is an interpolation in order to determined more precisely the pool level P relative to the confirmed station 60. This interpolation involves T(X−1), which means the temperature secured at the next station above the confirmed station 6, namely station 5. This interpolation also involves the water temperature WT, for example 85° F. and the OFFSET, for example 40° F. For example, if the temperature T(X−1) sensed by the higher temperature sensor 5*a* or 5*b* is 100° F. then the interpolation yields:

$$10\left(\frac{100^\circ - 85^\circ}{40^\circ}\right) = 10\left(\frac{15^\circ}{40^\circ}\right) = 3.75 \quad (2)$$

Adding this interpolation value of 3.75 to the already determined level of 40 gives a final pool level value P of 43.75 on the LEVEL SCALE 47. Accordingly, the system advantageously enables interpolation of the pool position between sensor stations which was not previously available and thereby permits more accurate determination of the actual position of the pool level P.

The present system advantageously enables interpolation between sensor stations by utilizing a contribution from the temperature of the next preceding upstream sensor as demonstrated in the examples chosen for purposes of illustration and provides redundancy to employ the higher temperature reading of a pair of sensors at a given station. This system also provides double confirmation of above-threshold signals in two successive stations in order to confirm the actual position of the pool level P.

The determination by the level calculator 62 is utilized either by manual response or by automatic controls to regulate the input feed rate 18 of the molten metal in order to maintain the continuous operation of the casting equipment 15.

In the above illustrative example the twenty sensors 1*a*, 1*b* through 10*a*, 10*b* for example include thermocouples, and each sensor has a response time of about one to two seconds. This response time means that when there is an actual change in temperature of the belt surface 12*a* at any given station, then a sensor at that station will begin showing a corresponding change in its output signal in about one to two seconds. The scan rate is about one millisecond per sensor, and thus the output signal of each sensor is repeatedly scanned or sampled several hundred times per second.

The present invention may also be utilized to advantage in controlling a twin-belt caster 15 for injection type casting using an injection feed nozzle (not shown). Initially, the pool level P is spaced away from the downstream end of the injection fed nozzle (not shown) as casting begins. The present invention is used to monitor and control pool level P for stabilizing pool level. Then, the pool level is gradually raised until the level of the pool is against the downstream end of the injection feed nozzle. Thereafter, the invention is used to make sure that the pool level does not drop down away from the injection feed nozzle.

Although the particular OFFSET of 40° F. is described above by way of example, it is to be understood that larger OFFSET values may be selected. Consequently, the threshold temperatures employed may be within a range from about 110° F. to about 160° F.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. The method of determining the level of molten metal in the input region of a continuous metal casting machine of the type having at least one endless, flexible, revolving casting belt with a casting surface which engages and travels with the molten metal to be cast and a reverse surface cooled by liquid coolant, said method comprising:

predetermining the desired range of positions of the level of the molten metal pool in the input region of the casting machine, positioning a series of at least seven transducing heat sensors in bearing contact with the moving reverse, cooled surface of the casting belt and spaced in upstream-downstream relation with respect to the direction of travel of the belt, said sensors being positioned in upstream-downstream spaced stations spanning said predetermined desired range of positions of the pool level, setting a predetermined temperature threshold which is offset by a predetermined temperature difference above the liquid coolant temperature, said liquid coolant temperature being the temperature of the liquid coolant as measured prior to the time when the liquid coolant is cooling said reverse surfaces, sequentially scanning the response of said sensors to temperatures of the moving cooled reverse surface of the belt, selecting a responding sensor in said series of sensors indicating a temperature exceeding threshold temperature confirming that the indication of said responding sensor is valid by determining whether sensors at the next two succeeding downstream stations are also indicating a temperature exceeding threshold temperature, thereby confirming that said responding sensor is validly indicating the presence of the pool level at the station of said responsive sensor, and interpolating the pool level above the station of said responding sensor by utilizing a contribution from the temperature of a sensor in the station next preceding the station of said responding sensor.

2. The method as claimed in claim 1 wherein ten transducing sensors are positioned in upstream-downstream spaced stations spanning said predetermined desired range of positions of the pool level.

3. The method as claimed in claim 2 wherein the sequential monitoring of said sensors is at a rate on the order of about one millisecond per sensor.

4. The method as claimed in claim 1 including the step of providing a redundancy capability by positioning two sensors at each station.

5. The method as claimed in claim 4 including the step of utilizing the higher temperature indication of the two sensors at each station.

6. The method as claimed in claim 1, wherein interpolating the pool level above the station of said responding sensor utilizes a contribution from the temperature "T" of a sensor in the station next preceding the station of said responding sensor and said contribution is calculated in accordance with a formula:

$$\text{Contribution} = f\left(\frac{T - WT}{\text{OFFSET}}\right)$$

where "T" is said temperature of said sensor in said next preceding station, where "WT" is the liquid coolant temperature, where "OFFSET" is the predetermined temperature differential by which threshold temperature exceeds liquid coolant temperature, and where "f" is a function of the number of stations.

7. The method as claimed in claim 1, wherein the pool level is evaluated on a level scale from 0 to 100 and wherein there are ten stations positioned in upstream-downstream spaced locations, each station containing at least one sensor, and including the further step of:

interpolating the pool level above the station of said responding sensor by utilizing a contribution from the temperature "T" of a sensor in the station next preceding the station of said responding sensor, said contribution being calculated in accordance with the formula:

$$\text{Contribution} = 10\left(\frac{T - WT}{\text{OFFSET}}\right)$$

where "T" is said temperature of said sensor in said next preceding station, where "WT" is the liquid coolant temperature, and where "OFFSET" is the predetermined temperature differential by which threshold temperature exceeds liquid coolant temperature.

8. The method as claimed in claim 7 wherein said liquid coolant temperature "WT" is maintained in the range of about 70° to about 90° F., and said "OFFSET" is about 40° F.

9. The method as claimed in claim 1 wherein said threshold temperature is set in the range of about 110° F. to about 160° F.

10. The method of determining the level of the molten metal pool in the input region of a continuous casting machine of the type having endless, flexible, revolving upper and lower casting belts forming a moving mold therebetween with the casting surfaces of said moving belts engaging the molten metal to be cast and the reverse surfaces of said belts being cooled by liquid coolant, said method comprising the steps of:

determining a desired range of positions of the level of the molten metal pool in the input region of the casting machine, positioning at least seven temperature sensing stations in upstream-downstream spaced locations along the reverse surface of the upper belt spanning said predetermined desired range of positions of the pool level, locating two transducing heat sensors at each station along said reverse surface of the upper belt, selecting a predetermined threshold temperature level which is above the liquid coolant temperature, said liquid coolant temperature being the temperature of the liquid coolant prior to contact of the liquid coolant with either reverse belt surface, scanning signals from said sensors, selecting and using the higher temperature indicating signal from the two sensors in each station, tentatively finding pool level to be at least equal to the location of the highest station having a sensor indicating of at least threshold temperature, and confirming that said tentative finding is valid by determining that a sensor in each of the next two succeeding stations in the downstream direction are also indicating temperatures of at least threshold temperature.

11. The method as claimed in claim 10, wherein there are ten stations with two sensors at each station.

12. The method as claimed in claim 11, wherein the scanning of said sensors is at a rate on the order of about one millisecond per sensor.

13. The method as claimed in claim 10, including the further step of interpolating the pool level above the station having a confirmed finding of pool level by adding an incremental contribution as a function of the higher of the two temperature indications of the two sensors in the next preceding station in the upstream direction, said function being of the form:

$$\text{Incremental Contribution} = f\left(\frac{T - WT}{\text{OFFSET}}\right)$$

where "T" is the higher of said two temperature indications, where "WT" is the liquid coolant temperature, and where "OFFSET" is the differential between threshold temperature and liquid coolant temperature.

14. The method as claimed in claim 10 wherein pool level is evaluated on a level scale from zero to-- one hundred and wherein there are ten stations each including two sensors and including the further step of interpolating the pool level above the station having a confirmed finding by adding an incremental contribution in accordance with the following formula:

$$\text{Incremental Contribution} = 10\left(\frac{T - WT}{\text{OFFSET}}\right)$$

where "T" is the higher of the two temperatures indications from the two sensors at the next higher station above the confirmed station, "WT" is the liquid coolant temperatures, and "OFFSET" is the differential between threshold temperature and liquid coolant temperature.

15. The method as claimed in claim 14 wherein threshold temperature is in the range from about 110° F. to about 160° F.,

* * * * *